US006532943B1

(12) United States Patent
Yudanov

(10) Patent No.: US 6,532,943 B1
(45) Date of Patent: Mar. 18, 2003

(54) HYDRAULICALLY ACTUATED ELECTRONICALLY CONTROLLED FUEL INJECTION SYSTEM

(75) Inventor: Sergi Yudanov, Göteborg (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/807,182

(22) PCT Filed: Jun. 11, 1999

(86) PCT No.: PCT/SE99/01029

§ 371 (c)(1),
(2), (4) Date: Jun. 28, 2001

(87) PCT Pub. No.: WO00/20752

PCT Pub. Date: Apr. 13, 2000

(30) Foreign Application Priority Data

Oct. 8, 1998 (AU) ..... PP6390

(51) Int. Cl.[7] ..... F02M 37/04
(52) U.S. Cl. ..... 123/502; 123/506; 123/446
(58) Field of Search ..... 123/446, 497, 123/502, 506, 447, 467; 239/88, 92, 96, 585.1

(56) References Cited

U.S. PATENT DOCUMENTS 5,722,373 A * 3/1998 Paul et al. ..... 123/357
6,213,093 B1 * 4/2001 Yudanov et al. ..... 123/446
6,237,857 B1 * 5/2001 Ausman et al. ..... 137/625.64
6,354,270 B1 * 3/2002 Shafer ..... 123/446
6,360,721 B1 * 3/2002 Schuricht et al. ..... 123/446

* cited by examiner

*Primary Examiner*—Tony M. Argenbright
*Assistant Examiner*—Hai Huynh
(74) *Attorney, Agent, or Firm*—Lerner, David, Littenberg, Krumholz & Mentlik, LLP

(57) ABSTRACT

Fuel injectors are disclosed for use in internal combustion engines including a housing which includes a working chamber, a piston, including a plunger, for reciprocal movement within the working chamber, a hydraulic valve having one side facing the control chamber and the other side facing a poppet chamber, and including a poppet defining the poppet chamber in communication with an inlet port and the working chamber, the poppet providing a throttling slot between the working chamber and the poppet chamber, a spring urging the hydraulic valve towards the closed position, a control valve between the control chamber and the spill port, and a bypass channel between the poppet chamber and the control chamber, whereby during initial movement of the hydraulic valve from its closed position to its open position the primary bypass channel is closed and when the hydraulic valve reaches an intermediate position the primary bypass channel is open.

24 Claims, 5 Drawing Sheets

HYDRAULICALLY ACTUATED ELECTRONICALLY CONTROLLED FUEL INJECTION SYSTEM

FIELD OF THE INVENTION

The present invention relates to a system for injecting fuel into compression ignition internal combustion engines.

BACKGROUND OF THE INVENTION

Certain fuel injection systems for engines have been designed as unit injectors which incorporate hydraulically driven pressure intensifiers with a stepped plunger for injecting fuel into the engine's cylinder, wherein the fuel delivery and timing are controlled by an electronically controlled valve. In addition, the spray pattern is controlled by means of modulating the base oil pressure supplied to the unit injector and/or by means of modulating the nozzle opening pressure.

The present invention concerns hydraulically actuated electronically controlled unit injection (HEUI) systems which are well known in the art. The most relevant art includes U.S. Pat. No. 5,785,021, the contents of which are incorporated herein by reference thereto.

U.S. Pat. No. 5,785,021 discloses a fuel injection system which comprises a pressure intensifier which is associated with hydraulically controlled differential valves. These valves comprise a poppet valve opening into a working chamber of the pressure intensifier. A throttling slot is provided between the poppet valve chamber and the working chamber, with either at least a bypass channel between the poppet valve chamber and a control chamber of the valve, or a bore connecting the working chamber to the control chamber of the valve.

Furthermore, International Application No. PCT/AU98/00073 discloses a fuel injection system in which a pressure intensifier is associated with a hydraulically controlled differential valve, which in turn defines a poppet opening into a working chamber of the pressure intensifier. The pressure intensifier comprises a plunger with an external groove for connection of a locking chamber of a nozzle with a compression chamber of the plunger during an injection cut-off position of the plunger, and for connection of the locking chamber to a control channel during other positions of the plunger. The pressure in the control channel is controlled by a hydraulic control system, which, in a preferred embodiment, is common for a set of injectors of the engine. In this manner, the injection system can be used for varying the shape of an injection curve and for providing a varying fuel injection pressure.

A primary object of the present invention is to provide an improved fuel injection system. In particular, it is an object of the present invention to provide improvements which increase the range of electronic control of an injection curve shape of the unit injector, improve the stability of fuel delivery in consecutive cycles of injections and between the unit injectors of a multi-cylinder engine, simplify the unit injector's design, and improve the injection end quality.

SUMMARY OF THE INVENTION

These and other objects have now been realized by the invention of a fuel injector for use in an internal combustion engine comprising a fuel injector housing including an inlet port for the fuel, a spill port for release of the fuel, a working chamber, a piston disposed for reciprocal movement within the working chamber, a plunger attached to the piston, a nozzle for injecting the fuel into the internal combustion engine in response to the action of the plunger, a hydraulic valve movable between a closed position, an open position, and at least one intermediate position therebetween, the hydraulic valve including a first side and a second side, the first side of the hydraulic valve facing a control chamber and the second side of the hydraulic valve facing a poppet chamber, whereby the hydraulic valve moves between the control chamber and the poppet chamber, the hydraulic valve including a poppet defining the poppet chamber, the poppet including a first side and a second side, the first side of the poppet defining the poppet chamber and being in communication with the inlet port and the second side of the poppet being in communication with the working chamber, the poppet disposed with respect to the working chamber so as to provide a throttling slot between the working chamber and the poppet chamber, biasing means for urging the hydraulic valve towards the closed position in which the poppet chamber is not in communication with the inlet port, a control valve disposed between the control chamber and the spill port, and a primary bypass channel for connecting the poppet chamber to the control chamber, whereby during at least a portion of the initial movement of the hydraulic valve from the closed position to the open position the primary bypass channel is closed and when the hydraulic valve reaches the at least one intermediate position the primary bypass channel is open. In accordance with a preferred embodiment, the hydraulic valve includes a groove proximate to the first side of the hydraulic valve, whereby when the hydraulic valve is closed the groove opens the primary bypass channel, when the hydraulic valve is in the at least one intermediate position the first side of the hydraulic valve opens the primary bypass channel, and when the hydraulic valve is in a second intermediate position between the closed position and the at least one intermediate position the primary bypass channel is closed.

In accordance with one embodiment of the fuel injector of the present invention, the fuel injector includes a secondary bypass channel connecting the poppet chamber to the control chamber. In a preferred embodiment the fuel injector includes a secondary valve disposed is the secondary bypass channel for altering the flow area of the secondary bypass channel. Preferably, the fuel injector includes an engine management system for controlling the secondary valve.

In accordance with another embodiment of the fuel injector of the present invention, the fuel injector includes a tertiary bypass channel connecting the poppet chamber to the control chamber.

In accordance with another embodiment of the fuel injector of the present invention, the secondary valve cannot completely close the secondary bypass channel.

In accordance with another embodiment of the fuel injector of the present invention, the fuel injector includes a hydraulic control system for controlling the secondary valve. Preferably, the fuel injector includes an engine management system for controlling the hydraulic control system.

In accordance with another embodiment of the fuel injector of the present invention, the fuel injector includes a solenoid for actuating the secondary valve.

In accordance with the present invention, these objects have also been realized by the invention of a fuel injector for use in an internal combustion engine comprising a fuel injector housing including an inlet port for the fuel, a spill port for release of the fuel, a working chamber, a piston disposed for reciprocal movement within the working chamber, a compression chamber, a plunger attached to the piston and defining at least a portion of the compression chamber, a nozzle for injecting the fuel into the internal combustion engine in response to actuation by the plunger, a needle movable between a first position closing the nozzle and a second position opening the nozzle, a locking chamber, first biasing means disposed within the locking chamber for urging the needle into the first position, an outlet chamber connecting the nozzle to the compression chamber, a non-return valve for permitting the fuel to enter the compression chamber from the inlet port, a cut-off channel connecting the locking chamber to the compression chamber, a control channel for connecting the cut-off channel to the spill port, a secondary control valve for controlling the flow from the control channel to the spill port, a link channel connecting the control channel to either the inlet port or to a hydraulic control system of the internal combustion engine, the link channel and the secondary control valve being disposed such that when the secondary control valve is open, the pressure in the control channel is less than the pressure between the link channel and either the inlet port or the hydraulic control system of the internal combustion engine, the plunger being movable between a first position and at least one second position, whereby when the plunger is in the first position the cut-off channel is connected to the compression chamber and when the plunger is in the at least one second position the cut-off channel is connected to the control channel.

In accordance with a preferred embodiment of the fuel injector of the present invention, the fuel injector includes a hydraulic valve movable between a closed position, an open position, and at least one intermediate position therebetween, the hydraulic valve including a first side and a second side, the first side of the hydraulic valve facing a control chamber and the second side of the hydraulic valve facing a poppet chamber, whereby the hydraulic valve moves between the control chamber and the poppet chamber, the hydraulic valve including a poppet defining the poppet chamber, the poppet including a first side and a second side, the first side of the poppet defining the poppet chamber and being in communication with the inlet port and the second side of the poppet being in communication with the working chamber, the poppet disposed with respect to the working chamber so as to provide a throttling slit between the working chamber and the poppet chamber, second biasing means for urging the hydraulic valve towards the closed position in which the poppet chamber is not in communication with the inlet port, a control valve disposed between the control chamber and the spill port, and a primary bypass channel for connecting the poppet chamber to the control chamber, whereby during at least a portion of the initial movement of the hydraulic valve from the closed position to the open position the primary bypass channel is closed and when the hydraulic valve reaches the at least one intermediate position the primary bypass channel is open. In a preferred embodiment, the hydraulic valve includes a groove proximate to the first side of the hydraulic valve, whereby when the hydraulic valve is closed the groove opens the primary bypass channel, when the hydraulic valve is in the at least one intermediate position the first side of the hydraulic valve opens the primary bypass channel, and when the hydraulic valve is in a second intermediate position between the closed position and the at least one intermediate position the primary bypass channel is closed. Preferably, the fuel injector includes a secondary bypass channel connecting the poppet chamber to the control chamber. Most preferably, the fuel injector includes a secondary valve disposed is the secondary bypass channel for altering the flow area of the secondary bypass channel. In a preferred embodiment, the fuel injector includes an engine management system for controlling the secondary valve.

In accordance with one embodiment of the fuel injector of the present invention the fuel injector includes a tertiary bypass channel connecting the poppet chamber to the control chamber.

In accordance with another embodiment of the fuel injector of the present invention, the secondary valve cannot completely close the secondary bypass channel.

In accordance with another embodiment of the fuel injector of the present invention, the fuel injector includes a hydraulic control system for controlling the secondary valve. Preferably, the fuel injector includes an engine management system for controlling the hydraulic control system.

In accordance with another embodiment of the fuel injector of the present invention, the fuel injector includes a solenoid for actuating the secondary valve.

In accordance with another embodiment of the fuel injector of the present invention, the secondary valve includes a control chamber connected to the control channel, and the fuel injector includes third biasing means urging the secondary valve to close the secondary bypass channel, whereby increasing the pressure in the control chamber overcomes the third biasing means to open the additional bypass channel, and lowering the pressure in the control chamber permits the secondary valve to reduce the flow in the secondary bypass channel. Preferably, the control valve and the secondary control valve comprise solenoid valves.

In accordance with one embodiment of the fuel injector of the present invention, the first biasing means has a variable stiffness.

In accordance with one embodiment of the present invention there is provided a fuel injection system for an internal combustion engine with a fuel injector, the injector comprising an inlet port; a spill port; a pressure intensifier comprising a piston forming a working chamber and a plunger adapted for injecting fuel through a nozzle; an hydraulic valve comprising a control chamber and a poppet chamber and having a poppet located between the inlet port and the working chamber and opening into the working chamber, wherein the poppet provides a throttling slot; means for biasing the hydraulic valve towards its closed position; a control valve installed between the control chamber and the spill port; a bypass channel for connection of the poppet chamber to the control chamber; and wherein the hydraulic valve is adapted to control the flow area of the bypass channel such that the bypass channel is open when the hydraulic valve is in its closed and open positions, or near these positions, and is closed during the other positions of the hydraulic valve.

In a preferred embodiment of the present invention, there is also a third bypass channel connecting the poppet and control chambers, such that when the additional bypass channel is closed by the secondary control valve, the third bypass channel defines the opening rate of the hydraulic valve during the positions of the hydraulic valve when it keeps the bypass channel closed.

In accordance with another embodiment of the present invention there is provided a fuel injection system for an internal combustion engine with a fuel injector, the injector comprising an inlet port; a spill port; a pressure intensifier comprising a piston forming a working chamber and a spill chamber and a plunger forming a compression chamber, wherein the working chamber is adapted to be connected either to the inlet port or to the spill port according to the commands from an engine management system in order to enable the pressure intensifier to perform injections; a nozzle with a needle, a locking chamber, means biasing the needle to close the nozzle and an outlet chamber connected to the compression chamber; a non-return valve, the inlet of the non-return valve being connected to the inlet port and the outlet of the non-return valve being connected to the compression chamber; a cut-off channel connected to the nozzle locking chamber; a control channel; an additional control valve installed between the control channel and the spill port; a link channel connecting the control channel to the inlet port; and in which the flow areas of the link channel and the additional control valve are such that when the additional control valve is open the pressure in the control channel becomes less than the pressure upstream of the link channel; the plunger being adapted to connect the cut-off channel to the compression chamber at an injection cut-off position of the plunger, and adapted to connect the cut-off channel to the control channel at other positions of the plunger.

The differences between the injector and injection system of an aspect of the present invention and that of the specifications mentioned above reside firstly in the inclusion of an additional bypass channel, connecting the poppet chamber to a control chamber, and a secondary valve which is adapted to control the flow area of the additional bypass channel in accordance with a pressure level in an hydraulic control system or in a control channel, where an hydraulic valve is adapted to control the flow area of a bypass channel for connection of the poppet chamber to the control chamber; secondly, the hydraulic valve controls the flow area of the bypass channel such that the bypass channel is open when the hydraulic valve is in its closed and open positions, or near these positions, and closed during the other positions of the hydraulic valve (HDV). By controlling the pressure in the hydraulic control system or in the control channel, the secondary valve can be controlled to open or close the additional bypass channel. When such pressure is increased, the secondary valve opens the additional bypass channel, and vice versa. As the opening speed of the hydraulic valve is dependent upon the flow area of the bypass channels, it is possible to control the opening speed of the hydraulic valve during its initial opening by controlling the position of the secondary valve and the flow area of the bypass channel. Slower hydraulic valve opening delays the injection pressure build-up. During the final part of the opening of the hydraulic valve the bypass channel is open and therefore the pressure in the control chamber is increased, which helps to fully open the hydraulic valve and reduce its hydraulic restriction.

It is preferable to use an hydraulic control system that is common for a set of injectors on an engine to control the positions of the secondary valves. The pressure in this common hydraulic control system is controlled by an engine management system. This helps to ensure uniform injection patterns throughout the engine cylinders, to simplify the injection system design and help keep the cost down as in this case only one pressure regulator is required and it can be mounted anywhere on an engine. Alternatively, the hydraulic control system can be replaced by a direct solenoid control of the secondary valves, which can be executed by a single solenoid and a mechanical arrangement transmitting the solenoid action to all of the injectors of an engine.

Another embodiment of the present invention resides in the provision of a link channel between a control channel and an inlet port, or between the control channel and an hydraulic control system, and in the provision of an additional control valve between the control channel and a spill port, in which a plunger is adapted to disconnect the control channel from a cut-off channel during a cut-off position of the plunger, and further where the flow areas of the additional control valve and the link channel are such that when the additional control valve is open the pressure in the control channel becomes less than the pressure in the hydraulic control system or in the inlet port. The pressure in the hydraulic control system is typically controlled by an engine management system. Thus, during a position of the plunger other than the cut-off position, a pilot or a boot injection is possible by means of opening the additional control valve. During the cut-off position of the plunger the control channel is disconnected from the cut-off channel, and the additional control valve is thus not subjected to a high pressure, and the volume of the cut-off channel is kept to a minimum.

Different embodiments of the present invention enable a wider range of control of the injection curve shape independently of the common rail (actuating) pressure, simplification of the unit injector design, and an improvement in the injection end quality and injector reliability.

BRIEF DESCRIPTION OF THE DRAWINGS

The present invention will now be described in more detail in the following detailed description, which, in turn, refers to the accompanying drawings, in which various embodiments of the unit injection system in accordance with the present invention are shown in different stages of operation, as follows.

DETAILED DESCRIPTION

Figure 1:
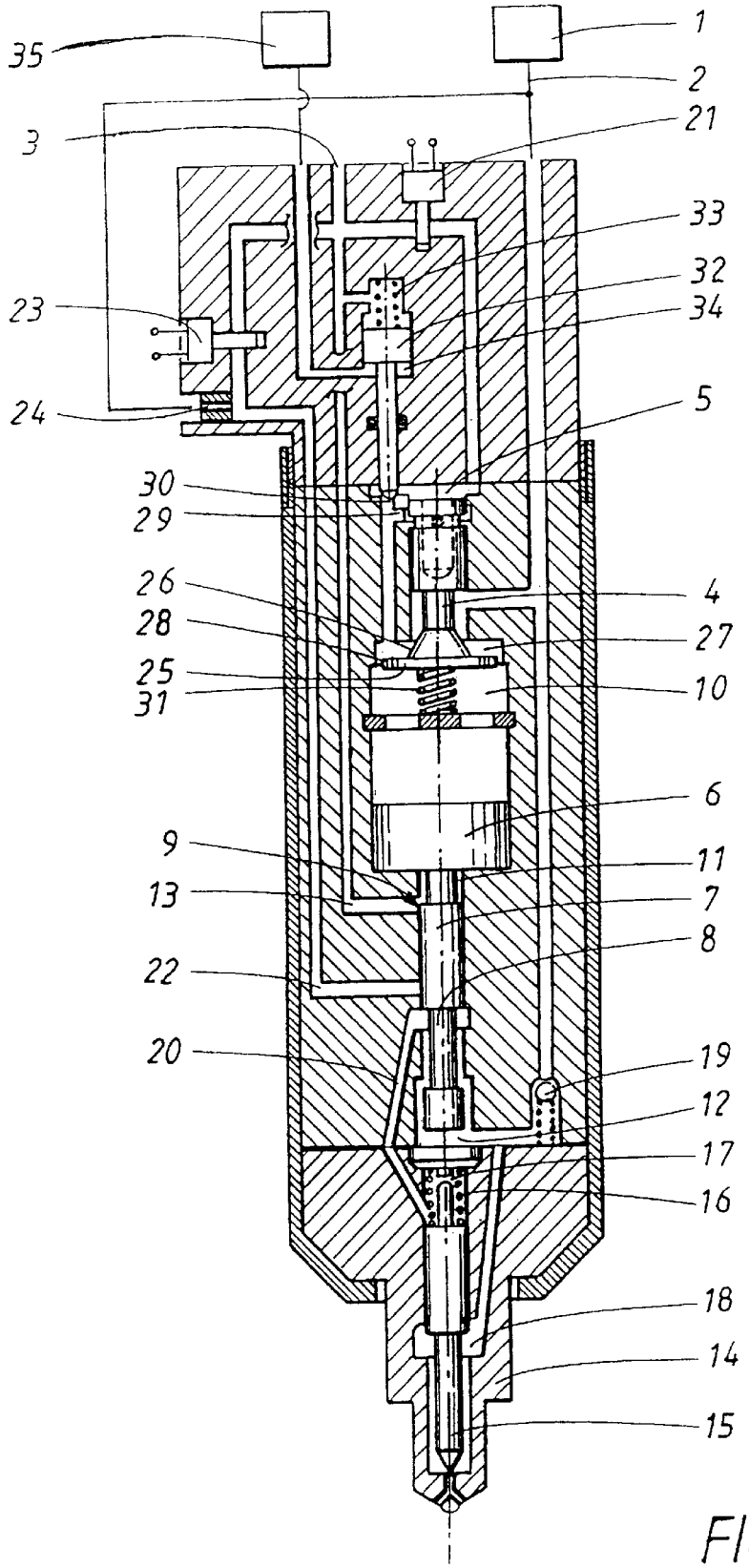
FIG. 1 is a side, elevational cross-sectional view of a first embodiment of the present invention.

The embodiment of the present invention shown in FIG. 1 shows a source of fuel pressure 1, inlet port 2, spill port 3, an hydraulic valve 4, preferably in the form of an hydraulically controlled differential valve (HDV), a control chamber 5, a pressure intensifier which comprises a piston 6 and plunger 7, with an external groove 8 and an edge 9, working chamber 10, spill chamber 11 and compression chamber 12, spill channel 13, nozzle 14, needle 15, spring 16, locking chamber 17 and outlet chamber 18, non-return valve 19, the inlet of which is connected to the inlet port 2, and the outlet of which is connected to the compression chamber 12, cut-off channel 20, control valve 21 installed between the control chamber 5 and the spill port 3, control channel 22, an additional control valve 23 installed between the control channel 22 and the spill port 3 and a link channel 24 connecting the control channel 22 to the inlet port 2.

The hydraulic valve 4 controls the flow area from the inlet port 2 to the working chamber 10 and opens towards the working chamber. The hydraulic valve 4 has a poppet 25 with a seating face 26 and forms a poppet chamber 27 and a throttling slot 28. There is a bypass channel 29 and an additional bypass channel 30 for connection of the poppet chamber 27 to the control chamber 5. The hydraulic valve 4 is biased towards its closed position by a spring 31. The compression chamber 12 is connected with the outlet chamber 18. The compression chamber 12 may also be connected with the cut-off channel 20 through the external groove 8 of the plunger 7, depending on the plunger's position. The cut-off channel 20 may be connected to the control channel 22 through the groove 8 of the plunger 7 depending on the plunger's position. The spill channel 13 may be connected to the spill chamber 11, depending on the plunger's position.

There is also a secondary valve 32 installed in the additional bypass channel 30 and biased by a spring 33 to close the additional bypass channel. The secondary valve has a control chamber 34 connected to an hydraulic control system 35.

Figure 2:
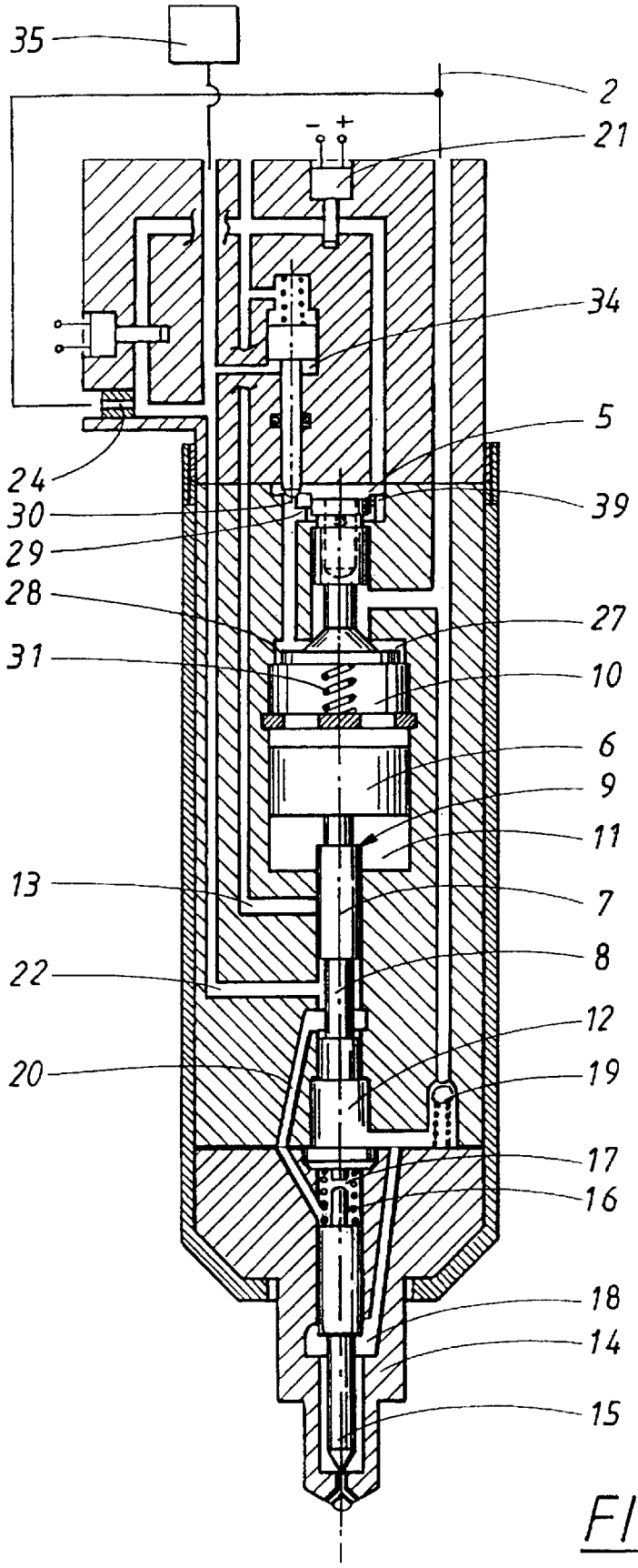
FIG. 2 is a side, elevational, cross-sectional view of a second embodiment of the present invention.

The hydraulic valve 4 is designed such that its upper edge 36 (See FIG. 3) can open or close the bypass channel 29, depending on the position of the hydraulic valve. With the hydraulic valve closed the upper edge 36 closes the bypass channel 29 as shown in FIG. 2. In a certain position of the hydraulic valve during its opening stroke the edge 36 (FIG. 3) opens the bypass channel and keeps it open as the hydraulic valve opens further.

The hydraulic valve also has a groove 37 with an edge 38 which can control the flow area of the bypass channel 29 such that when the hydraulic valve is closed, the edge 38 opens the bypass channel, and at a certain point of the opening stroke of the hydraulic valve the edge 38 closes the bypass channel. In the preferred embodiment, during the opening stroke of the hydraulic valve the edge 38 closes the bypass channel before the upper edge 36 opens the bypass channel again, so that it remains closed on a part of the opening stroke of the hydraulic valve.

A second embodiment of the present invention is shown in FIG. 2 and is identical to that shown in FIG. 1 except that there is a third bypass channel 39 connecting the poppet chamber 27 to the control chamber 5.

Figure 4:
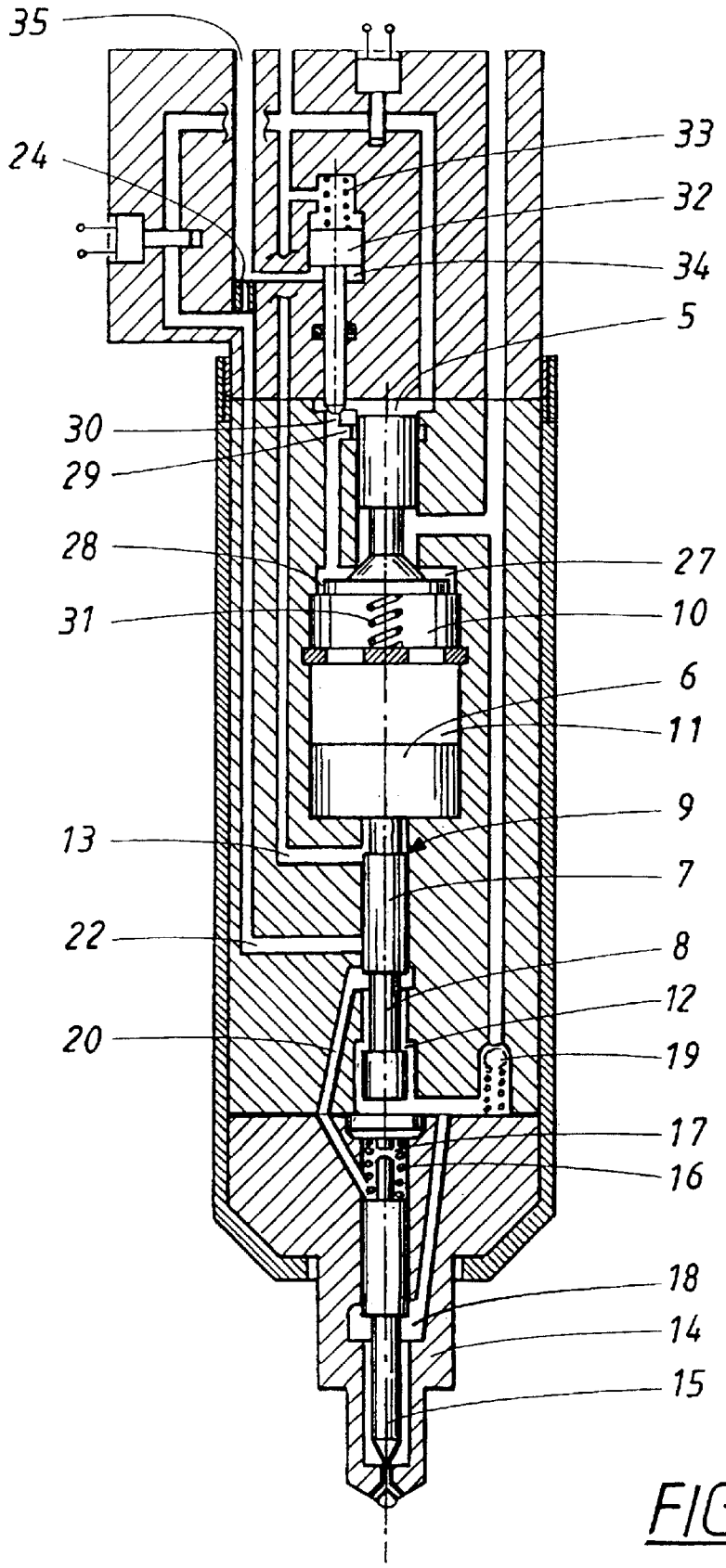
FIG. 4 is a side, elevational, cross-sectional view of a third embodiment of the present invention.

An alternate form of the present invention is shown in FIG. 4 which is identical to that shown in FIG. 1 except that there is no groove on the hydraulic valve 4 and no third bypass channel, and the secondary valve 32 is designed such that it cannot completely close the additional bypass channel 30. In addition, the link channel 24 connects the control channel 22 to the hydraulic control system 35 instead of connecting channel 22 to the inlet port.

Figure 5:
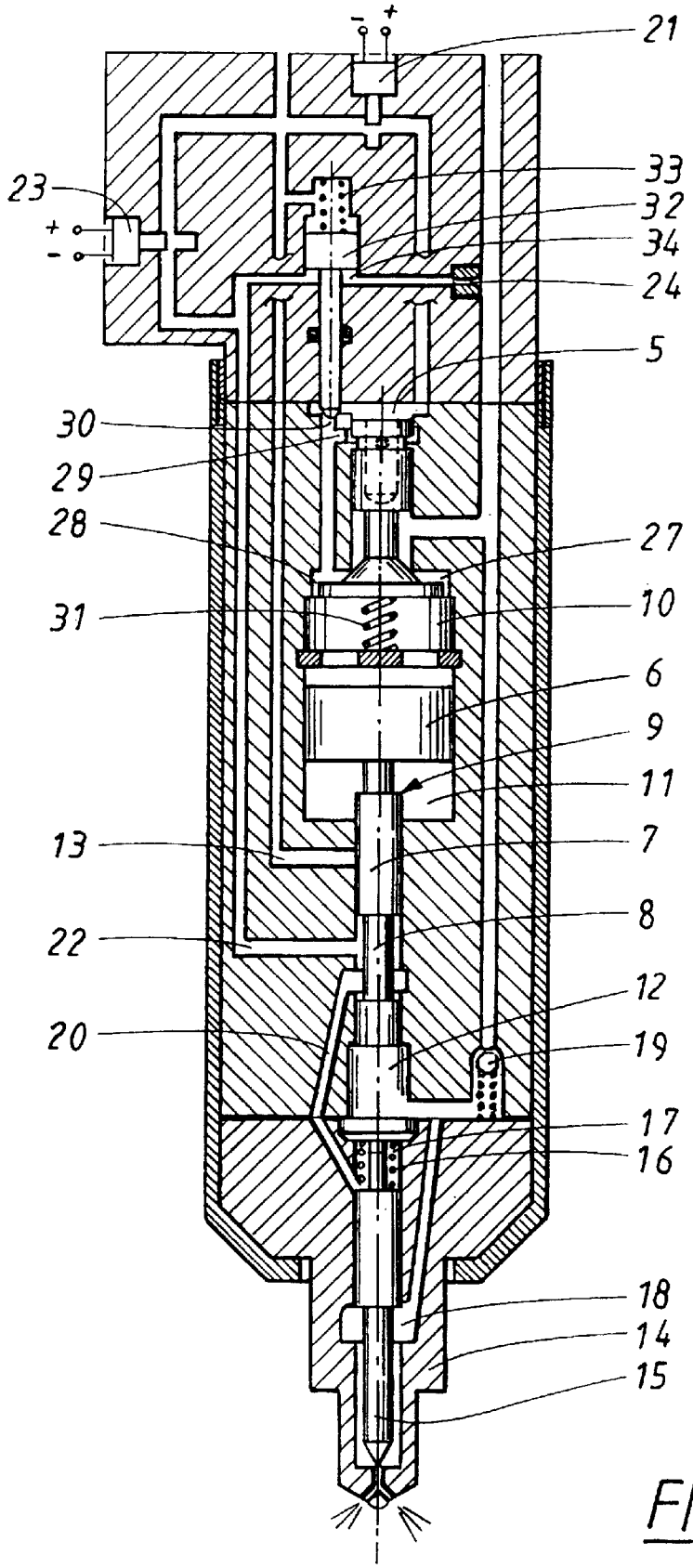
FIG. 5 is a side, elevational, cross-sectional view of a fourth embodiment of the present invention.

Another alternate form of the present invention is shown in FIG. 5 which is identical to that shown in FIG. 1 except that the control chamber 34 of the secondary valve 32 is connected to the control channel 22 instead of being connected to the hydraulic control system.

The fuel injection system of the depicted embodiments works as follows.

Figure 3:
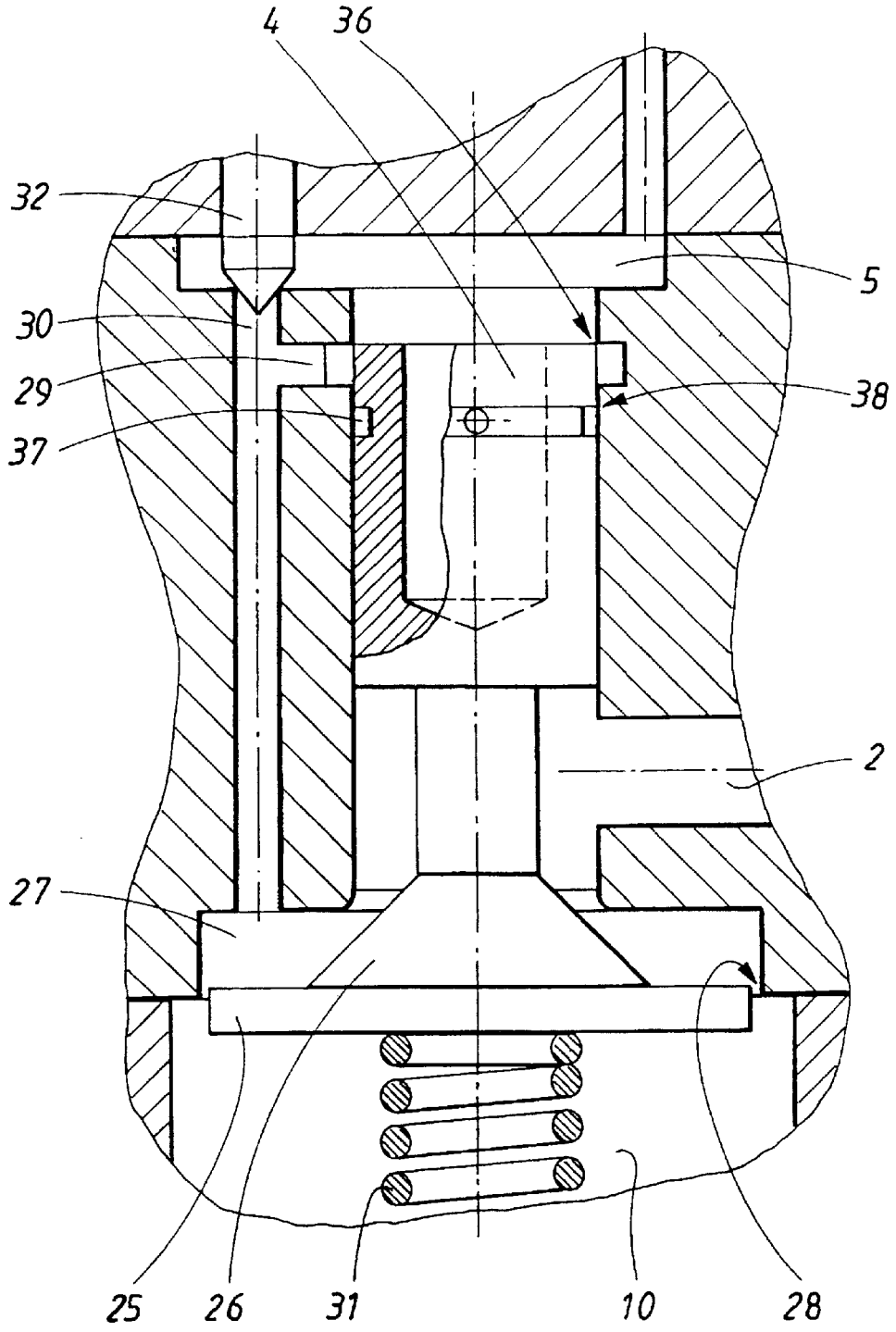
FIG. 3 is a side, elevational, partial, enlarged, cross-sectional view of the hydraulic differential valve shown in FIG. 1.

Referring to FIG. 1, in the initial position the control valve 21 is inert and closes off the connection between the control chamber 5 and spill port 3. In the case where the pressure in the hydraulic control system 35 is set to a low level by an engine management system (not shown), the spring 33 overcomes the force exerted by the pressure in the control chamber 34 on the secondary valve 32 and keeps the additional bypass channel 30 closed as shown. The hydraulic valve 4 is pushed by the spring 31 in the direction of closing the hydraulic valve until it reaches a first intermediate position where the upper edge 36 of the hydraulic valve (Ref. FIG. 3) closes the bypass channel 29. Then the hydraulic valve stays in the first intermediate position as the fuel cannot escape from the control chamber 5 with the control valve 21 and the bypass channels 29 and 30 are closed. Referring to FIG. 1, the piston 6 and plunger 7 are kept in the bottom position by the fuel pressure in the working chamber 10, the locking chamber 17 is connected by means of the cut-off channel 20 and the plunger's external groove 8 with compression chamber 12, and the nozzle 14 is closed by the needle 15. The spill chamber 11 is connected to the spill port 3 by means of spill channel 13. The additional control valve 23 is de-energized and closed.

When electric current is supplied to the control valve 21 it connects the control chamber 5 to the spill port 3 and allows the hydraulic valve to move further towards the closed position. At a certain point, the hydraulic valve reaches a second intermediate position in which the edge 38 (See FIG. 3) begins to open the bypass channel 29 as the hydraulic valve moves on. Finally, the hydraulic valve closes the connection between the inlet port 2 and the poppet chamber 27, as shown in FIG. 2. The control valve 21 stays open and allows the fuel to flow from the working chamber 10 through the throttling slot 28 to poppet chamber 27, further through bypass channel 29 to control chamber 5 and out through spill port 3. The flow area of the throttling slot 28 is such that the flow through it causes the hydraulic force to act on the hydraulic valve 4 in the direction of the flow, which holds the hydraulic valve closed with the additional assistance of the force exerted by the spring 31. When the pressure in the working chamber 10 has decreased to a certain level, piston 6 and plunger 7 move up under the pressure in the compression chamber 12, the fuel pressure being transmitted through the non-return valve 19. At a certain point in the travel of the plunger its groove 8 closes the connection between compression chamber 12 and the cut-off channel 20, and at or beyond this point it isolates cut-off channel 20, and thereby the locking chamber 17, from the compression chamber 12. In the point of further upward movement of the plunger when its groove 8 opens the connection between the cut-off channel 20 and the control channel 22 thereby connecting the locking chamber 17 with control channel 22, and at or beyond this point it keeps locking chamber 17 and control channel 22 connected with each other (FIG. 2). In this manner, the pressure in the locking chamber 17 equalizes with the pressure in the control channel 22. Also, at a certain point in the travel of the plunger its edge 9 closes off the connection between spill chamber 11 and spill channel 13, and at or beyond this point the spill port 3 and spill chamber 11 remain disconnected from each other. The period of time during which piston 6 and plunger 7 move up is determined by the duration of opening of the control valve 21, which is in turn determined by the duration of the current supplied by the engine management system.

The operation of the present invention will now be described with reference to so-called pilot injection and boot injection, which are types of injection which are previously known. The term "pilot injection" refers to a small separate injection preceding a main injection. Usually 1 to 10% of the total fuel delivered in a cycle may be injected during the pilot injection. The term "boot injection" refers to a single injection shaped like a front end of a boot, i.e. with a low "step" in the beginning of the injection and then a gradual rise of the injection rate and pressure from this low level.

If a pilot or a boot-shaped injection is required, while the plunger 7 has not yet started an injection stroke, the current is supplied to the additional control valve 23, which opens. The flow areas of the open valve 23 and the link channel 24 are such that the pressure in the control channel 22, and therefore in the locking chamber 17, is reduced. The reduced pressure in the locking chamber allows the pressure in the outlet chamber 18 to lift the needle 15, provide an initial opening of the nozzle 14, and begin injection of fuel which is supplied to the outlet chamber 18 from the inlet port 2 through the non-return valve 19. If a pilot injection is required, the additional control valve 23 is closed before a main injection is started, and the pressure in the control channel 22 and in the locking chamber 17 then equalize with the pressure in the inlet channel 2, and the nozzle is closed by the spring 16. If a boot-shaped injection is required, the additional control valve is closed at a later stage so that the nozzle does not close before main injection starts. FIG. 5 illustrates the instant when a boot injection is in progress while the piston 6 and the plunger 7 are still travelling up with the valve 21 open.

When the piston 6 and the plunger 7 have reached a required position which is determined by the fuel delivery required at that instant, the current supplied to the control valve 21 is switched off and the valve 21 closes, thereby isolating the control chamber 5 and spill port 3. As a result, the fuel flow through the throttling slot 28 stops and the hydraulic force holding the hydraulic valve 4 closed ceases to act. The fuel pressure in the inlet port 2 acting on the differential spot in the hydraulic valve overcomes the force of spring 31 and provides an initial opening of the hydraulic valve. This allows fuel to flow through the inlet port 2 to the poppet chamber 27 and through the throttling slot 28 to working chamber 10, and by means of the bypass channel 29 to the control chamber 5. This fuel flow increases the pressure in poppet chamber 27 and control chamber 5 which forces hydraulic valve 4 to open. The pressure in the working chamber 10 rises and causes the piston 6 and the plunger 7 to move down thereby compressing the fuel in the compression chamber 12 and closing the non-return valve 19.

As the fuel pressure in the compression chamber 12 increases, the pressure in the nozzle outlet chamber 18 also increases and opens the nozzle 14, overcoming the force of spring 16 and pressure in the locking chamber 17. In this manner, a main injection is started. The moment of nozzle opening, and correspondingly the pressure developed in the compression chamber 12 at the moment of nozzle opening, depend on the pressure in the locking chamber 17, which is equal to the pressure in the control channel 22. If a boot injection is already in progress, the increase in pressure in the compression chamber 12 resulting from the injecting stroke of the plunger completes the boot stage of the injection and starts the main injection.

When the opening hydraulic valve arrives at the second intermediate position as described above, the edge 38 (See FIG. 3) closes the bypass channel 29. The part of the opening stroke of the hydraulic valve from the second intermediate position to the first intermediate position is characterized by a lower pressure in the control chamber 5 due to the increasing volume of the chamber and the fact that the bypass channels 29 and 30 are closed. The throttling slot 28 is designed such that the pressure differential between the poppet chamber 27 and the working chamber 10 provides an hydraulic force on the poppet 25 which is sufficient to open the hydraulic valve even if the pressure in the control chamber 5 falls below atmospheric pressure. However, the lower pressure in the control chamber 5 impedes faster opening of the hydraulic valve. A slower opening of the hydraulic valve, in turn, delays a pressure increase in the working chamber 10 during an injection stroke of the plunger 7. This provides for a more gradual rise of injection pressure.

If a more rapid rate of rise of injection pressure is desired in the beginning of a main injection, then the engine management system sets the pressure in the hydraulic control system 35 (FIG. 1) to a higher level, which overcomes the force of spring 33 and lifts up the secondary valve 32, opening the additional bypass channel 30. A relatively large flow area between the poppet chamber 27 and the control chamber 5 in this case helps to maintain a higher pressure in the control chamber 5 during the entire opening stroke of the hydraulic valve, which increases its opening rate and therefore the rate of injection pressure rise in the beginning of an injection.

During an injection stroke of the piston 6 and the plunger 7 fuel is injected through opened nozzle 14. At a final stage of an injection stroke the groove 8 disconnects the cut-off channel 20 from the control channel 22 and then opens the connection between the compression chamber 12 and the cut-off channel 20. In addition, at a final stage of an injection stroke the edge 9 opens the connection between spill chamber 11 and spill port 3. With the cut-off channel 20 and compression chamber 12 connected to each other the pressures in locking chamber 17 and compression chamber 12 equalize, and the needle 15 closes nozzle 14 and the piston 6 and the plunger 7 stay at the bottom of the stroke. When the piston is stationary there is no fuel flow through the hydraulic valve 4 and the pressures in the working chamber 10, poppet chamber 27 and control chamber 5 equalize, with the pressure in the inlet port 2 and the spring 31 moving the hydraulic valve up. Thus, the system returns to the initial position as shown in FIG. 1.

The main principle upon which the present invention is based relates to the fact that the hydraulic valve is designed so that it can completely close the connection between the poppet chamber 27 and the control chamber 5 during an initial part of the opening stroke of the hydraulic valve. This allows for a more significant reduction of the opening speed of the hydraulic valve during an initial part of its opening stroke. Furthermore, additional bypass channel 30 is arranged between the poppet and control chambers, and the secondary valve 32 is arranged in this additional bypass channel 30. As a consequence, application of the secondary valve 32 in the additional bypass channel 30 provides for flexible electronic control and for a wider control range of the opening rate of the hydraulic valve (and hence the injection curve shape).

In an alternate form of the present invention shown in FIG. 2 the fuel injection system works in the same way. In the initial position, the spring 31 closes the hydraulic valve 4 completely, even when the secondary valve 32 is closed because there is the third bypass channel 39 which allows the fuel to escape from the control chamber 5 back to the poppet chamber 27 and the working chamber 10 during the closing of the hydraulic valve. The third bypass channel 39 is designed such that while the hydraulic valve is between the second and first intermediate positions during its opening stroke, the third bypass channel provides sufficient restriction to the flow from the poppet chamber 27 to the control chamber 5 to keep the pressure in this chamber low (provided that the additional bypass channel 30 is closed), thus reducing the rate of injection pressure rise in the beginning of a main injection as described above. By varying the flow area of the third bypass channel 39 it is possible to alter the degree of rate shaping of the main injection which can be activated or deactivated by closing or opening the secondary valve 32.

In another alternate form of the present invention shown in FIG. 4 the fuel injection system works in the same way.

The third bypass channel is absent, and the secondary valve 32 is designed such that it cannot completely close the additional bypass channel 30. When the secondary valve 32 is pushed by the spring 33 against its stop as shown in FIG. 4, it leaves the poppet chamber 27 and the control chamber 5 still connected to each other and thus the function of a third bypass channel, as described above, is maintained.

The fact that the link channel 24 connects the control channel 22 to the hydraulic control system 35, instead of the inlet port 2, allows for an improvement in the controllability of the pilot injections, especially at low common rail pressures. This is because the pressure in the system 35 can be kept higher than in the inlet port when a low injection pressure is desired, so that the forces acting on the needle 15 to close the nozzle 14 and end a pilot injection will be higher and the closing period of the needle will be shorter.

In yet another alternate form of the present invention shown in FIG. 5 the fuel injection system works in the same way except that in this case the position of the secondary valve 32 is determined by the pressure in the control channel 22. When the additional control valve 23 is closed, the pressure in the control channel 22 is high and the secondary valve 32 opens the additional bypass channel 30. When the valve 23 opens and the pressure in the control channel 22 and therefore in the control chamber 34 falls down due to a relatively small flow area of the link channel 24, the secondary valve 32 closes the additional bypass channel 30. By this means, the control over the shape of the leading front of the main injection curve can be exercised without the need of a separate hydraulic control system.

Other embodiments of the present invention are also possible which incorporate the features of the present invention described above in different combinations, for example, the control channel 22 can be connected directly to the hydraulic control system 35 in FIG. 1 without the use of the additional control valve 23 and the link channel 24, so that the nozzle opening pressure and the flow area of the additional bypass channel 30 can both be controlled through pressure modulation in the hydraulic control system. A lower pressure would provide for both a slower initial rise of injection pressure, as the nozzle would open at a lower pressure in the outlet chamber 18, and for a slower injection pressure increase at the later stages of injection due to slower opening of the hydraulic valve 4, and vice versa. Another possible embodiment would incorporate a resilient means biasing the needle 15 to close the nozzle 14, which has a variable stiffness, such that an initial opening of the needle is possible at a lower pressure in the outlet chamber 18, but at other positions of the needle when it is close to its maximum lift the stiffness of the resilient means increases. This will assist quicker closing of the nozzle during an injection cut-off. Such a variable stiffness can be achieved by the use of a well-known two-spring design of the resilient means.

The advantages of the present invention over known fuel injection systems are achieved mainly by the following means:

- application of the hydraulic valve 4, which is adapted to control the flow area of the bypass channel 29 such that the bypass channel is open when the hydraulic valve is in its closed and open positions or near these positions and closed during the other positions of the hydraulic valve;
- application of the additional bypass channel 30 for connection of the poppet chamber 27 to the control chamber 5;
- application of the secondary valve 32, which is installed in the additional bypass channel 30 and which can control the flow area of this channel depending on the commands of the engine management system;
- application of the third bypass channel 39 connecting the poppet chamber 27 to the control chamber 5;
- application of the additional control valve 23 between the control channel 22 and the spill port 3, whereby the plunger 7 is adapted to connect the control channel to the cut-off channel 20 at some positions of the plunger, other than its cut-off positions, and connect the cut-off channel 20 to the compression chamber 12 during the cut-off positions of the plunger, and application of the link channel 24 connecting the control channel 22 to the inlet port 2 or, alternatively, to the hydraulic control system 35, wherein the flow areas of the link channel 24 and the open additional control valve 23 are such that when the additional control valve is open the pressure in the control channel is reduced.

Application of the hydraulic valve 4 which is adapted to control the flow area of the bypass channel 29 such that the bypass channel is open when the hydraulic valve is in the closed and open positions, or near these positions, and closed during its other positions, allows one to reduce the opening speed of the hydraulic valve on the first parts of its opening stroke, achieving a more gradual rise of the injection pressure, and at the same time reduce the maximum flow area of the control valve 21 which is required to hold the hydraulic valve in the closed position when the control valve 21 is open, because the pressure drop across the hydraulic valve in this case acts on the area of the poppet 27 which is larger than the area of the cylindrical sealing surface of the hydraulic valve. In the known fuel injection systems, such as the system disclosed in U.S. Pat. No. 5,785,021, the working chamber is in permanent and direct connection with the control chamber in order to facilitate transport of fuel from the working chamber to the spill port when the control valve is open and the HDV is closed, as the bypass channel in this position of the HDV is closed. Therefore, the pressure drop across the HDV in the case of prior art injection system acts on the area of the sealing cylindrical surface of the HDV, which is smaller than the area of the poppet, which requires a bigger pressure drop to hold the HDV closed and consequently a larger flow area for the control valve 21. Moreover, such a permanent connection of the HDV control chamber to the working chamber prevents efficient reduction of the opening speed of the HDV during a part of its opening stroke taking place at the closed bypass channel.

Application of the additional bypass channel 30 for connection of the poppet chamber 27 to the control chamber 5 allows one to achieve the same objective of reducing the maximum flow area of the control valve 21 which is necessary to hold the hydraulic valve closed in case the bypass channel 29 is closed in this position of the hydraulic valve, as described above, but without the additional groove 37 on the hydraulic valve.

Application of the secondary valve 32, which is installed in the additional bypass channel 30, and which can control the flow area of this channel depending on the commands of the engine management system, allows for electronic control of the rate of injection pressure increase in the beginning of injection. If the secondary valve is open, the opening speed of the hydraulic valve is not reduced by a lower pressure in the control chamber 5 because it is connected to the poppet chamber 27 at all times, and if the secondary valve 32 is closed, the opening speed of the hydraulic valve is slower on the first parts of its opening stroke due to a lower pressure in the control chamber 5 as the bypass channel is closed when the hydraulic valve is between its second and first intermediate positions. Application of the third bypass channel connecting the poppet chamber to the control chamber allows one to adjust the opening speed of the hydraulic valve between its second and first intermediate positions when the additional bypass channel 30 is closed by the secondary valve 32 and therefore adjust the shape of the leading front of the main injection. This can be accomplished by optimizing the flow area of the third bypass channel 39, the distances between the open, first, second and closed positions of the hydraulic valve, and the design of the throttling slot 28 of the hydraulic valve.

Application of the additional control valve 23 between the control channel 22 and the spill port 3, wherein the plunger 7 is adapted to connect the control channel to the cut-off channel 20 at some positions of the plunger other than its cut-off positions, and connect the cut-off channel 20 to the compression chamber 12 during the cut-off positions of the plunger, and application of the link channel 24 connecting the control channel 22 to the inlet port 2 or, alternatively, to the hydraulic control system 35, wherein the flow areas of the link channel 24 and the open additional control valve 23 are such that when the additional control valve is open the pressure in the control channel is reduced, allows one to achieve electronic control of pilot or boot injections and at the same time improve the shape of the rear front of an injection curve, simplify the injector design and increase its reliability. In the known fuel injection systems, such as the system disclosed in International Patent Application No. PCT/AU98/00073, the additional control valve which controls the pilot or boot injections is installed in the control channel which is connected to the cut-off channel of the injector at all times, so that during the cut-off of injection a high pressure is present in the control channel, and therefore the additional control valve must be able to seal against high pressure, which complicates the injector design. This also entails a larger volume to which the cut-off fuel is directed, which slows the needle closing and therefore deteriorates the shape of the injection curve. Application of the link channel 24 according to the present invention, as described above, allows one to install the additional control valve in the control channel which is disconnected from the cut-off channel during the cut-off positions of the plunger, so that the nozzle opening pressure can be controlled by the additional control valve but this valve is not subject to high pressure during a cut-off of injection. This is also beneficial in terms of equalizing the nozzle opening pressures of different injectors of an engine and in consecutive cycles of injection, as the pressure in the nozzle locking chamber 17 in case of incomplete sealing in the closed additional control valve will still be equal to the pressure in the inlet port (or the hydraulic control system). In case of the prior art injection system, a change in the leakage rate from the control channel is more likely to affect the nozzle opening pressure.

It will be appreciated by persons skilled in the art that numerous variations and/or modifications may be made to the present invention as shown in these specific embodiments without department from the spirit or scope of the invention as broadly described. The present embodiments are, therefore, to be considered in all respects as illustrative and not restrictive.

For example, other types of valves can be used instead of the hydraulically controlled differential valve 4 described above, due to the fact that neither the control channel 22, the additional control valve 23 nor the link channel 24 are related to the design of a hydraulically controlled differential valve.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A fuel injector for use in an internal combustion engine comprising a fuel injector housing including an inlet port for said fuel, a spill port for release of said fuel, a working chamber, a piston disposed for reciprocal movement within said working chamber, a plunger attached to said piston, a nozzle for injecting said fuel into said internal combustion engine in response to the action of said plunger, a hydraulic valve movable between a closed position, an open position, and at least one intermediate position therebetween, said hydraulic valve including a first side and a second side, said first side of said hydraulic valve facing a control chamber and said second side of said hydraulic valve facing a poppet chamber, whereby said hydraulic valve moves between said control chamber and said poppet chamber, said hydraulic valve including a poppet defining said poppet chamber, said poppet including a first side and a second side, said first side of said poppet defining said poppet chamber and being in communication with said inlet port and said second side of said poppet being in communication with said working chamber, said poppet disposed with respect to said working chamber so as to provide a throttling slot between said working chamber and said poppet chamber, biasing means for urging said hydraulic valve towards said closed position in which said poppet chamber is not in communication with said inlet port, a control valve disposed between said control chamber and said spill port, and a primary bypass channel for connecting said poppet chamber to said control chamber, whereby during at least a portion of the initial movement of said hydraulic valve from said closed position to said open position said primary bypass channel is closed and when said hydraulic valve reaches said at least one intermediate position said primary bypass channel is open.

2. The fuel injector of claim 1 wherein said hydraulic valve includes a groove proximate to said first side of said hydraulic valve, whereby when said hydraulic valve is closed said groove opens said primary bypass channel, when said hydraulic valve is in said at least one intermediate position said first side of said hydraulic valve opens said primary bypass channel, and when said hydraulic valve is in a second intermediate position between said closed position and said at least one intermediate position said primary bypass channel is closed.

3. The fuel injector of claim 1 including a secondary bypass channel connecting said poppet chamber to said control chamber.

4. The fuel injector of claim 3 including a secondary valve disposed is said secondary bypass channel for altering the flow area of said secondary bypass channel.

5. The fuel injector of claim 4 including an engine management system for controlling said secondary valve.

6. The fuel injector of claim 4 including a tertiary bypass channel connecting said poppet chamber to said control chamber.

7. The fuel injector of claim 4 wherein said secondary valve cannot completely close said secondary bypass channel.

8. The fuel injector of claim 4 including a hydraulic control system for controlling said secondary valve.

9. The fuel injector of claim 8 including an engine management system for controlling said hydraulic control system.

10. The fuel injector of claim 4 including a solenoid for actuating said secondary valve.

11. A fuel injector for use in an internal combustion engine comprising a fuel injector housing including an inlet port for said fuel, a spill port for release of said fuel, a working chamber, a piston disposed for reciprocal movement within said working chamber, a compression chamber, a plunger attached to said piston and defining at least a portion of said compression chamber, a nozzle for injecting said fuel into said internal combustion engine in response to actuation by said plunger, a needle movable between a first position closing said nozzle and a second position opening said nozzle, a locking chamber, first biasing means disposed within said locking chamber for urging said needle into said first position, an outlet chamber connecting said nozzle to said compression chamber, a non-return valve for permitting said fuel to enter said compression chamber from said inlet port, a cut-off channel connecting said locking chamber to said compression chamber, a control channel for connecting said cut-off channel to said spill port, a secondary control valve for controlling the flow from said control channel to said spill port, a link channel connecting said control channel to either said inlet port or to a hydraulic control system of said internal combustion engine, said link channel and said secondary control valve being disposed such that when said secondary control valve is open, the pressure in said control channel is less than the pressure between said link channel and either said inlet port or said hydraulic control system of said internal combustion engine, said plunger being movable between a first position and at least one second position, whereby when said plunger is in said first position said cut-off channel is connected to said compression chamber and when said plunger is in said at least one second position said cut-off channel is connected to said control channel.

12. The fuel injector of claim 11 including a hydraulic valve movable between a closed position, an open position, and at least one intermediate position therebetween, said hydraulic valve including a first side and a second side, said first side of said hydraulic valve facing a control chamber and said second side of said hydraulic valve facing a poppet chamber, whereby said hydraulic valve moves between said control chamber and said poppet chamber, said hydraulic valve including a poppet defining said poppet chamber, said poppet including a first side and a second side, said first side of said poppet defining said poppet chamber and being in communication with said inlet port and said second side of said poppet being in communication with said working chamber, said poppet disposed with respect to said working chamber so as to provide a throttling slit between said working chamber and said poppet chamber, second biasing means for urging said hydraulic valve towards said closed position in which said poppet chamber is not in communication with said inlet port, a control valve disposed between said control chamber and said spill port, and a primary bypass channel for connecting said poppet chamber to said control chamber, whereby during at least a portion of the initial movement of said hydraulic valve from said closed position to said open position said primary bypass channel is closed and when said hydraulic valve reaches said at least one intermediate position said primary bypass channel is open.

13. The fuel injector of claim 12 wherein said hydraulic valve includes a groove proximate to said first side of said hydraulic valve, whereby when said hydraulic valve is closed said groove opens said primary bypass channel, when said hydraulic valve is in said at least one intermediate position said first side of said hydraulic valve opens said primary bypass channel, and when said hydraulic valve is in a second intermediate position between said closed position and said at least one intermediate position said primary bypass channel is closed.

14. The fuel injector of claim 12 including a secondary bypass channel connecting said poppet chamber to said control chamber.

15. The fuel injector of claim 14 including a secondary valve disposed is said secondary bypass channel for altering the flow area of said secondary bypass channel.

16. The fuel injector of claim 15 including an engine management system for controlling said secondary valve.

17. The fuel injector of claim 15 including a tertiary bypass channel connecting said poppet chamber to said control chamber.

18. The fuel injector of claim 17 wherein said secondary valve includes a control chamber connected to said control channel, and including third biasing means urging said secondary valve to close said secondary bypass channel, whereby increasing the pressure in said control chamber overcomes said third biasing means to open said additional bypass channel, and lowering the pressure in said control chamber permits said secondary valve to reduce the flow in said secondary bypass channel.

19. The fuel injector of claim 18 wherein said control valve and said secondary control valve comprise solenoid valves.

20. The fuel injector of claim 15 wherein said secondary valve cannot completely close said secondary bypass channel.

21. The fuel injector of claim 15 including a hydraulic control system for controlling said secondary valve.

22. The fuel injector of claim 15 including an engine management system for controlling said hydraulic control system.

23. The fuel injector of claim 15 including a solenoid for actuating said secondary valve.

24. The fuel injector of claim 11 wherein said first biasing means has a variable stiffness.

* * * * *

UNITED STATES PATENT AND TRADEMARK OFFICE

CERTIFICATE OF CORRECTION

PATENT NO. : 6,532,943 B1
DATED : March 18, 2003
INVENTOR(S) : Sergi Yudanov

It is certified that error appears in the above-identified patent and that said Letters Patent is hereby corrected as shown below:

Column 16,
Line 49, “15” should read -- 21 --.

Signed and Sealed this

Nineteenth Day of August, 2003

JAMES E. ROGAN
*Director of the United States Patent and Trademark Office*